United States Patent [19]

Murakami

[11] 4,393,620

[45] Jul. 19, 1983

[54] ROCKET TRAIN TOY ASSEMBLY

[75] Inventor: Kazuya Murakami, Tokyo, Japan

[73] Assignee: Takara Co., Ltd., Osaka, Japan

[21] Appl. No.: 288,948

[22] Filed: Jul. 31, 1981

[51] Int. Cl.[3] ..... A63H 11/10

[52] U.S. Cl. ..... 46/201

[58] Field of Search ..... 46/219, 217, 201, 202, 46/251, 206, 17, 111, 112, 215

[56] References Cited

U.S. PATENT DOCUMENTS

| | | | |
|---|---|---|---|
| 3,300,894 | 1/1967 | Glass et al. | 46/202 |
| 4,236,345 | 12/1980 | Inoue | 46/202 X |
| 4,244,144 | 1/1981 | Goldberg et al. | 46/116 X |

FOREIGN PATENT DOCUMENTS

| | | | |
|---|---|---|---|
| 929536 | 6/1955 | Fed. Rep. of Germany | 46/201 |
| 2060414 | 5/1981 | United Kingdom | 46/202 |
| 2068751 | 8/1981 | United Kingdom | 46/201 |

*Primary Examiner*—Mickey Yu

*Attorney, Agent, or Firm*—Jackson, Jones & Price

[57] ABSTRACT

The present invention is directed to a reconfigurable toy which is capable of simulating a locomotive train in one position and through a timed release being reconfigured into a rocket plane configuration in a second position.

12 Claims, 4 Drawing Figures

ROCKET TRAIN TOY ASSEMBLY

BACKGROUND OF THE INVENTION

1. Field of the Invention

The present invention is directed to the toy industry, and more particularly to a mobile toy assembly that can be reconfigured from a toy vehicle into a second action toy in a controlled manner.

2. Description of the Prior Art

The toy industry has provided a large number of various designed mobile toys for use by children. These vehicle toys are generally limited to relatively few play options for the child. Since the child's span of attention is so unlimited, the enjoyment value of the toy will increase in direct proportion to the variation in action modes that are capable of being exercised. The capability of reconfiguring toy vehicles in the prior art is well known, such as set forth in U.S. Pat. No. 4,214,402 and U.S. Pat. No. 4,170,840.

As can be readily appreciated, the toy industry is always striving to increase the novelty in play options available to a child such as that provided by the present invention.

SUMMARY OF THE INVENTION

The present invention provides a toy assembly in the form of a toy vehicle that can be subsequently and automatically reconfigured into a second type of action toy in a controlled manner. The toy assembly includes a housing member having a plurality of moving parts that can be activated and translated relative to the basic housing member to form a second action toy. A timing mechanism is employed to provide a controlled reconfiguration over a predetermined time period. For example, the toy vehicle can be configured to initially resemble a modernistic train locomotive and then reconfigured to form a rocket jet plane.

The relatively flat front end of the train configuration can assume a cone or aeronautic shape of a front end of a plane with the sides of the train expanding to form wings. Mounted within the basic housing body is a timing mechanism which includes a rack and pinion gear transmission assembly that is further controlled by a camming escape mechanism. Springs bias the various movable parts of the housing member into a second toy action configuration. The release of an appropriate switch mechanism permits the conversion of the train into a rocket plane over a relatively slow predetermined time period.

While various configurations of the body member are possible, the preferred embodiment is in the format of a modernistic train prime mover that is converted into a rocket ship.

The objects and features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DESCRIPTION OF THE PREFERRED EMBODIMENTS

The following description is provided to enable any person skilled in the toy industry to make and use the invention and sets forth the best mode contemplated by the inventor of carrying out his invention. Various modifications, however, will remain readily apparent to those skilled in the toy industry, since the generic principles of the present invention have been defined herein specifically to provide a relatively economical and easily manufactured toy assembly.

Figure 1:
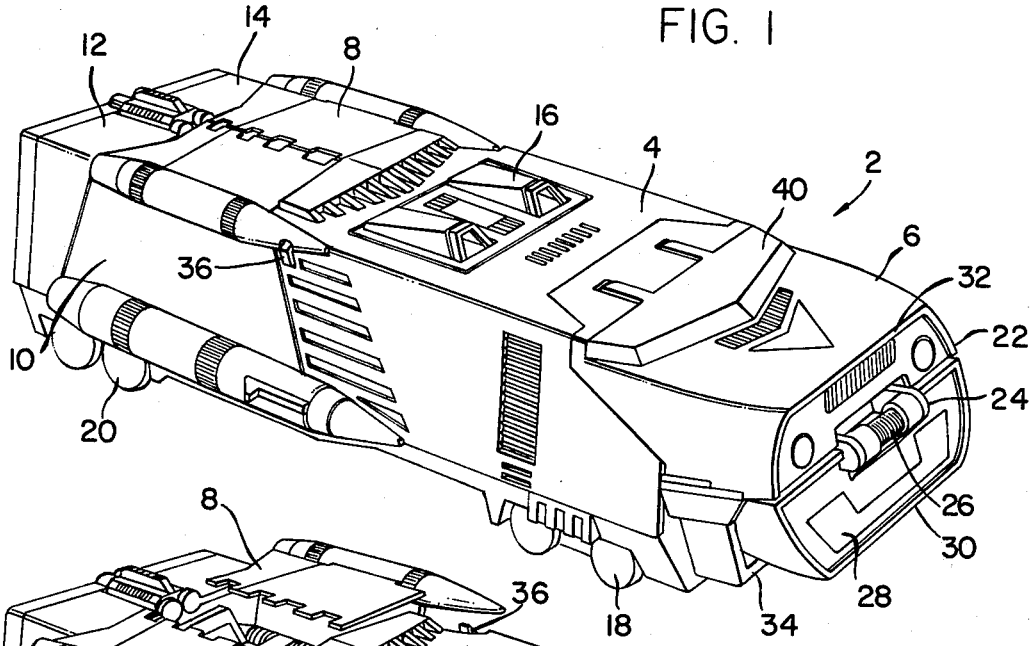
FIG. 1 is a perspective view of a train configuration of the present invention.
Figure 2:
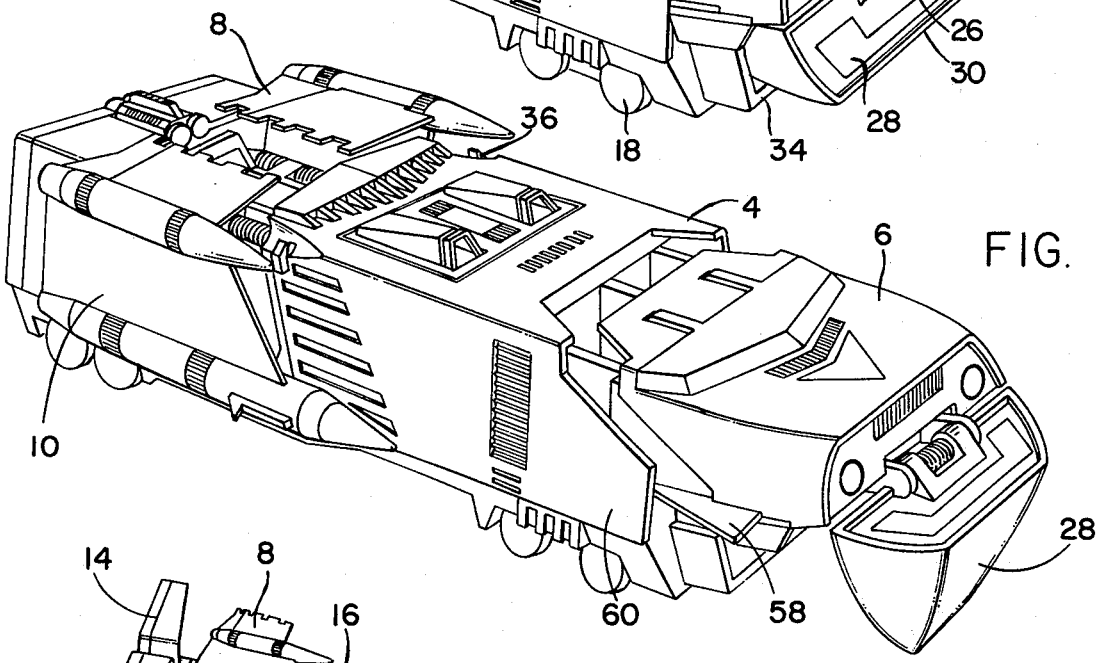
FIG. 2 is a perspective view disclosing the relative movement of various component parts of the present invention.

Referring to FIG. 1, a perspective view of a preferred embodiment of the present invention is disclosed in the form of a modernistic train locomotive 2. The configuration could also equally be of some other form of toy vehicle, particularly of an elongated configuration, such as a truck or other surface vehicle.

The train 2 comprises a first housing member 4 having a longitudinal axis and a relatively movable second housing member 6 that is configured to simulate the front portion of a locomotive train. Adjacent the rear of the first housing member 4 are first and second outer wall members 8 and 10 that are pivotally articulated and capable of forming a square type of configuration consistent with the outer envelope of a simulated locomotive train. When these wall members 8 and 10 are extended, they form rocket plane wings. Rocket projectile mechanisms 42 can be positioned on each of the wing wall members 8 and 10. Finally, at the rear of the train are pivotally mounted tail wing portions 12 and 14. Again, the outer surface of these tail wing portions are complementary to the rectangular configuration of a locomotive train when folded against the housing member 4.

Mounted on the upper surface of the first housing member 4 are a pair of interconnected switch members 16 also configured to enhance the impression of a locomotive train configuration. A conventional set of wheels 18 and 20 are provided at the respective front and rear of the first housing member 4.

Figure 3:
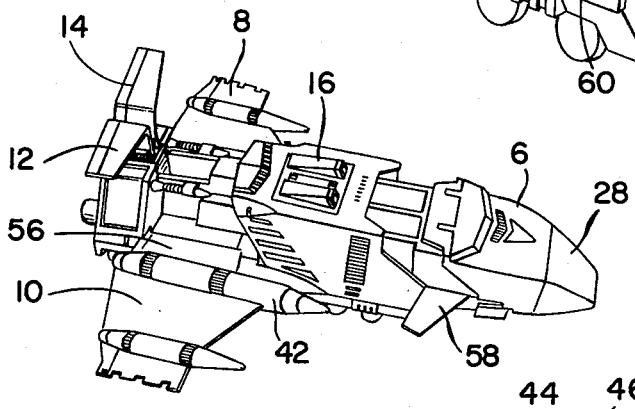
FIG. 3 is a perspective view disclosing the reconfigured toy in the form of a rocket ship.

The front portion 22 of the second housing member 6 includes conventional headlights and other indicia simulating the front of a locomotive train. The lower half 28, however, of this front portion 22 is pivotally mounted at a joint 24 and biased by a coiled spring 26 to position the lower half 28 upward so that its lower edge 30 abuts against an upper edge 32 as best seen in FIG. 3. The lower half 28 is further configured to form a cone or nose portion of a rocket plane and is restrained, when the toy is placed in the configuration of a locomotive train as shown in FIG. 1, by the edge 34 of the lower portion of the first housing member 4.

Figure 4:
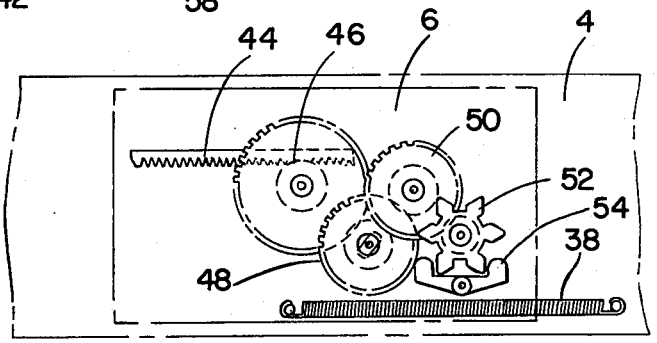
FIG. 4 is a partial schematic plan view of the timing mechanism of the present invention.

A keeper member 36 is positioned on either side of the first housing member 4 to interface with respective outer wall members 8 and 10. The keeper member is biased by a spring (not shown) and is released by the activation of either one of the switches 16. Switch 16 is, in effect, a single switch with a double lever or button pad. While not shown, the switch member 16 further is connected to the relatively movable second housing member 6 and holds it in the retracted train locomotive configuration against the bias of spring 38 shown in FIG. 4.

A canopy 40 is pivotally mounted to the second housing member 6 and can be opened to receive a small play figure.

A timing mechanism includes a geared rack member 44 that is integrally molded in plastic along with the remainder of the housing member 4. The rack member 44 is positioned on the interior surface above the front wheels 18 to interface with a lower pinion gear 46 extending downward from the internal lower surface of the second housing member 6. A series of drive gears and pinion gears, such as members 48 and 50, provide a gear reduction and drive the pinion gear of a starred cam configuration 52. A follower release or escape member 54 is pivotally mounted to sequentially start and stop the movement of the cam gear to set a predetermined time for releasing the energy stored in spring 38.

In operation, the second housing member 6 can be folded back into the spring biased position disclosed in FIG. 1 with the respective outer wall members 8 and 10 folded so that the wing pods are held in place by the respective keeper members 36. Finally, the tail wing portions 12 and 14 are manually folded against the first housing member 4 to maintain an elongated rectangular train-like configuration. In this mode of operation, the child can move the toy figure by virtue of the wheel sets 18 and 20. By activation of the switch member 16, the outer wall members 8 and 10 immediately are released from the keeper member 36 and are biased by respective coiled springs (not shown) centrally located within each rocket mechanism 42 to immediately move to a horizontal open wing position. These respective main wing members 8 and 10 can be further translated outward, or traversed to a longitudinal axis of the first housing member 4, to assume the final position shown in FIG. 3. That is, the respective articulated wall members 8 and 10 can be further moved away from the body of the first housing member 4 as represented in FIG. 3 by the displacement of the rocket projectile mechanism 42 from the first housing member 4. This manual movement by the child exposes the wing extension portion 56 shown in FIG. 3, while further providing a clearance for the respective rocket projectile mechanisms 42 from the body of the housing member 4. Activation of the switch member 16 further releases the second housing member 6 so that the resilient tension of the spring member 38 is gradually released by the timing mechanism disclosed in FIG. 4. When the housing member 6 has advanced far enough for the edge of the lower half member of the front portion 22 to clear the edge 34 of the first housing member, the bias of coil spring 26 is sufficient to immediately pop it upward into the configuration shown in FIG. 3. A pair of internal coil springs (not shown) are mounted to bias a pair of front side wing members 58 to an extended operative position. Thus, when the second housing member 6 is translated sufficiently away from the first housing member 4, the wing members 58 are simply extended as is well known in the prior toy art. Conversely, when the second housing member 6 is retracted manually into the first housing member 4, the vertical panels 60 of the first housing member 4 cam the wing members into a stored spring bias condition within the first housing member 4.

The particular arrangement of the rack and pinion with the gear transmission assembly and escape mechanism conveniently provides a timed control release whereby the primary wing members for the rocket plane configuration shown in FIG. 3 are immediately sprung to a vertical position with the articulated portions of each wing portion extended outward, while the front reconfiguration requires approximately five seconds for complete activation to assume the configuration shown in FIG. 3. Subsequently, the child manually manipulates the rear tail wing portions 12 and 14 and can further extend each of the primary wing members laterally outward from the first housing member 4. The actual perception by the child of this reconfiguration mode of operation is that the toy device is more than simply spring biased, since the escape mechanism produces a whirring sound and the slow release of the energy gives the impression that it is a battery-driven electric toy of considerably more cost.

What is described above is a spring powered reconfigurable action toy which initially provides a configuration of a futuristic train locomotive and can be subsequently automatically reconfigured to an aeronautical vehicle such as a rocket plane. It will be readily apparent to those skilled in the toy manufacturing field that various modifications of the present invention are possible, and accordingly, the scope thereof should be interpreted solely from the following claims.

What is claimed is:

1. A reconfigurable toy comprising:

a first housing member having a longitudinal axis configured to simulate a portion of a surface vehicle in an initial position;

a second housing member configured to simulate the front portion of a surface vehicle and relatively movable along the longitudinal axis from the first housing member, a portion of the second housing member is pivotally movable to reconfigure the front portion of the surface vehicle configuration into the nose portion of an aeronautical vehicle when placed in a second position;

first and second outer wall members are pivotally mounted to the first housing member and are simulated to complement a surface vehicle configuration in an initial position and to extend away from the first housing member to a second position to provide a set of wings for an aeronautical vehicle configuration;

means for biasing the outer wall members and the portion of the second housing member to an aeronautical vehicle configuration when placed into an initial position of a surface vehicle, and means for activating the reconfiguration by releasing the outer wall members and portion of the second housing member to be moved by the biasing means.

2. The invention of claim 1 further including a rear portion of the first housing member that can be pivotally configured into a tail wing assembly.

3. The invention of claim 2 wherein the second housing member includes a pair of biased wings.

4. A reconfigurable toy comprising:

a first housing member having a longitudinal axis configured to simulate a portion of a locomotive train in an initial position;

a second housing member configured to simulate the front portion of a locomotive train and relatively movable along the longitudinal axis from the first housing member, a portion of the second housing member is pivotally movable to reconfigure the front portion of the locomotive configuration into the nose portion of a rocket plane when placed in a second position;

first and second outer wall members are pivotally mounted to the first housing member and are simulated to complement a locomotive train configuration in an initial position and to extend away from the first housing member to a second position to provide a set of wings for a rocket plane configuration;

means for biasing the outer wall members and the portion of the second housing member to a rocket plane configuration when placed into an initial position of a locomotive train, and means for activating the reconfiguration by releasing the outer wall members and portion of the second housing member to be moved by the biasing means.

5. The invention of claim 4 wherein the means for activating includes timing means for providing a controlled movement of the second housing member against the biasing means for a predetermined time period.

6. The invention of claim 5 wherein the timing means includes a rack and pinion gear, the rack mounted on one of the first or second housing members and the pinion gear mounted on the other.

7. The invention of claim 5 wherein the pinion gear is connected to a transmission gear assembly and a camming release mechanism.

8. The invention of claim 4 further including a rear portion of the first housing member that can be pivotally configured into a tail wing assembly.

9. The invention of claim 4 wherein the outer wall members further include means for firing projectiles.

10. The invention of claim 4 wherein the second housing member includes a pair of biased wings.

11. The invention of claim 4 wherein the outer wall members are also laterally movable relative to the first housing member.

12. The invention of claim 4 wherein the portion of the second housing member is pivotally movable to extend upward and forward of the second housing member to provide a juxtaposition of the lower edge with the upper edge.

* * * * *